US010388201B2

(12) United States Patent
Chang et al.

(10) Patent No.: US 10,388,201 B2
(45) Date of Patent: Aug. 20, 2019

(54) POWER CYCLE DISPLAY SENSING

(71) Applicant: Apple Inc., Cupertino, CA (US)

(72) Inventors: Sun-Il Chang, San Jose, CA (US); Hyunwoo Nho, Stanford, CA (US); Hung Sheng Lin, San Jose, CA (US); Junhua Tan, Santa Clara, CA (US); Jie Won Ryu, Campbell, CA (US); Kingsuk Brahma, Mountain View, CA (US); Jesse A. Richmond, San Francisco, CA (US); Mohammad B. Vahid Far, San Jose, CA (US); Yafei Bi, Los Altos Hills, CA (US)

(73) Assignee: Apple Inc., Cupertino, CA (US)

( * ) Notice: Subject to any disclaimer, the term of this patent is extended or adjusted under 35 U.S.C. 154(b) by 8 days.

(21) Appl. No.: 15/697,132

(22) Filed: Sep. 6, 2017

(65) Prior Publication Data

US 2018/0082620 A1 Mar. 22, 2018

Related U.S. Application Data

(60) Provisional application No. 62/396,547, filed on Sep. 19, 2016.

(51) Int. Cl.

| | |
|---|---|
| ***G09G 3/00*** | (2006.01) |
| ***G09G 3/20*** | (2006.01) |
| ***G09G 5/00*** | (2006.01) |

(52) U.S. Cl.

CPC ..... *G09G 3/006* (2013.01); *G09G 3/2092* (2013.01); *G09G 5/00* (2013.01);
(Continued)

(58) Field of Classification Search

CPC ..... G09G 3/006; G09G 3/2092; G09G 5/00; G09G 5/02; G09G 5/10; G09G 2330/026;
(Continued)

(56) References Cited

U.S. PATENT DOCUMENTS

| | | | |
|---|---|---|---|
| 6,166,766 | A | 12/2000 | Moore et al. |
| 8,921,855 | B2 | 12/2014 | Okita et al. |

(Continued)

OTHER PUBLICATIONS

Kiyun Kwon et al.; "A Fully Differential Correlated Double Sampling Readout Circuit for Mutual-Capacitance Touch Screens", Journal of Semiconductor Technology and Science, vol. 15, No. 3, Jun. 2015, pp. 349-355.

(Continued)

*Primary Examiner* — Sardis F Azongha
(74) *Attorney, Agent, or Firm* — Fletcher Yoder, PC

(57) ABSTRACT

Electronic devices and methods pertain to reducing artifacts resulting from a thermal profile preexisting a boot up of an electronic device are disclosed. Scanning driving circuitry of the electronic device scans at least a portion of one or more pixels of an active area of a display using a boot up scan before a boot up sequence of at least a portion of an electronic device completes. The results of the boot up scan are stored in local buffers and transferred to one or more processors upon connection to the one or more processors. The results of the boot up scan cause the one or more processors to modify image data to reduce or eliminate artifacts that may result during boot up due to thermal profiles or other parameters that may cause artifacts.

20 Claims, 8 Drawing Sheets

(52) U.S. Cl.
CPC ..... *G09G 2320/041* (2013.01); *G09G 2320/0693* (2013.01); *G09G 2330/026* (2013.01)

(58) Field of Classification Search
CPC ..... G09G 2330/04; G09G 2320/041; G09G 2320/043; G09G 2320/0666; G06F 9/4401; G06F 9/4405; G06F 9/4406; G06F 9/4408; G06F 9/441; G06F 1/26
See application file for complete search history.

(56) References Cited

U.S. PATENT DOCUMENTS 8,970,808 B2 * 3/2015 Drolet ..... G02F 1/13306 349/150
9,542,196 B2 * 1/2017 Zhang ..... G06F 9/4411
2007/0079162 A1 * 4/2007 Mundada ..... G06F 1/26 713/330
2012/0206426 A1 * 8/2012 Sakakima ..... G09G 3/3426 345/207
2013/0227261 A1 * 8/2013 Anderson ..... G06F 9/4401 713/2
2013/0300690 A1 11/2013 Yang et al.
2013/0321361 A1 12/2013 Lynch et al.
2014/0111567 A1 * 4/2014 Nathan ..... G09G 3/3233 345/694
2015/0373291 A1 12/2015 Oh et al.
2016/0071487 A1 * 3/2016 Lu ..... G09G 3/3208 345/690
2016/0086540 A1 3/2016 Kim
2016/0163255 A1 6/2016 Kim et al.
2016/0189630 A1 6/2016 Chang et al.

OTHER PUBLICATIONS

International Search Report and Written Opinion for PCT Application No. PCT/US2017/050517 dated Nov. 29, 2017; 16 pgs.

* cited by examiner

POWER CYCLE DISPLAY SENSING

CROSS REFERENCE TO RELATED APPLICATIONS

This application claims the benefit of U.S. Provisional Application No. 62/396,547, filed on Sep. 19, 2016, the contents of which are herein expressly incorporated by reference for all purposes.

BACKGROUND

The present disclosure relates generally to techniques for correcting for thermal variation of a display after or during a power cycle.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Image artifacts may appear on an electronic display due to thermal variations of the electronic display. Thermal variations may arise due to other electronic components near the electronic display, such as a processor or wireless network transceiver, but may also arise due to external sources such as sunlight on different areas on the display. Since individual pixels of the electronic display may operate differently depending on the temperature, these thermal variations could result in image artifacts. For example, if one area of the electronic display is hotter than another part of the electronic display, pixels from the different areas that receive image data of the same color might appear to be different when the pixels should be uniform. Pixel behavior sensing may be used to identify and correct these artifacts, but sensing takes some time, possibly causing display of the artifacts for some time.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Electronic devices and methods pertain to reducing image artifacts on an electronic display that are caused by thermal variations on the electronic display. A stored thermal profile representing a map of the temperature of the electronic display may be used to adjust image data before it is sent to the electronic display, and therefore avoid image artifacts caused by the thermal variations. Yet an inaccurate thermal profile could result in improper corrections that do not fully correct the image artifacts. If the thermal profile is inaccurate upon boot-up of an electronic device, the image data may not be fully corrected until the thermal profile is updated through pixel behavior sensing, during which time any displayed images could have noticeable image artifacts.

Scanning driving circuitry of the electronic device may reduce image artifacts due to an inaccurate thermal profile on boot-up by scanning at least a portion of one or more pixels of an active area of a display using a boot-up scan before a boot-up sequence of at least a portion (e.g., display) of an electronic device completes. The results of the boot up scan are stored in local buffers and transferred to one or more processors upon connection to the one or more processors. The results of the boot up scan cause the one or more processors to modify image data to reduce or eliminate artifacts that may result during boot up due to inaccurate thermal profiles or other parameters that may cause artifacts.

BRIEF DESCRIPTION OF THE DRAWINGS

Various aspects of this disclosure may be better understood upon reading the following detailed description and upon reference to the drawings in which.

DETAILED DESCRIPTION

Figure 1:
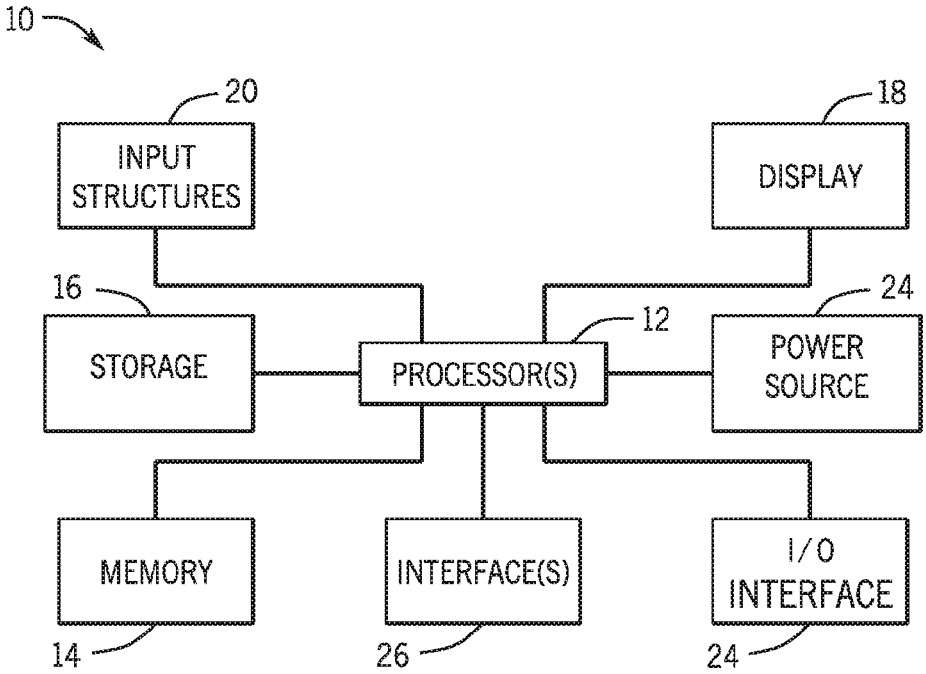
FIG. 1 is a schematic block diagram of an electronic device including a display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As previously discussed, image artifacts due to thermal variations on an electronic display (e.g., an organic light emitting diode, or OLED) display panel can be corrected using external compensation (e.g., using processors) by adjusting image data based on a correction profile using a sensed thermal profile of the electronic display. The thermal profile is actual distribution of heat inside the electronic display, and the correction profile is the sensed heating and a resulting image data correction for each heat level. For instance, higher thermal levels may cause pixels to display brighter in response to image data. Once these levels are sensed, the processor may create a correction profile based on the sensed data that inverts expected changes based on the thermal profile and applies them to image data so that the correction and the thermal variation cancel each other out causing the image data to appear as it was stored.

After power cycling, a residual (or pre-existing) thermal profile from previous usage can cause significant artifacts until an external compensation loop corrects the artifact using processors external to the display. The processors may use the external compensation loop to generate the correction profile In addition, any thermal variation built during off-display, such as LTE usage, light, and ambient temperature, can also cause artifacts. In this warm boot-up condition, sensing of variation due to temperature and correction of image data may be performed quickly to minimize initial artifacts. Every power cycle, sensing and correction of the whole screen can be performed during power-on sequence. This may take place even before panel starts to display images or even establishes communication with processors used to externally compensate for the thermal profile. Sensing and correction of the entire screen may involve programming driving circuitry to conduct sensing after a boot up before establishing communication with the processors that may cause sensing during scanning phases of normal operation. Furthermore, since the scanning may be performed before establishment of communication with the processors for external compensation, sensing results may be stored in a local buffer (e.g., group of line buffers) until communication with the processors 12 is established.

With the foregoing in mind and referring first to FIG. 1, an electronic device 10 according to an embodiment of the present disclosure may include, among other things, one or more processor(s) 12, memory 14, nonvolatile storage 16, a display 18, input structures 20, an input/output (I/O) interface 22, a power source 24, and an interface(s) 26. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

In the electronic device 10 of FIG. 1, the processor(s) 12 and/or other data processing circuitry may be operably coupled with the memory 14 and the nonvolatile storage 16 to perform various algorithms. Such programs or instructions, including those for executing the techniques described herein, executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and/or optical discs. Also, programs (e.g., e.g., an operating system) encoded on such a computer program product may also include instructions that may be executed by the processor(s) 12 to enable the electronic device 10 to provide various functionalities.

In certain embodiments, the display 18 may be any suitable electronic display to allow users to view images generated on the electronic device 10. In some embodiments, the display 18 may include a touch screen, which may allow users to interact with a user interface of the electronic device 10. The display 18 may be a self-emissive display that uses pixels formed from light emitting diodes (e.g., LED) or may be a backlit liquid crystal display (LCD).

The input structures 20 of the electronic device 10 may enable a user to interact with the electronic device 10 (e.g., e.g., pressing a button to increase or decrease a volume level, a camera to record video or capture images). The I/O interface 22 may enable electronic device 10 to interface with various other electronic devices. The I/O interface 22 may include various types of ports that may be connected to cabling. These ports may include standardized and/or proprietary ports, such as USB, RS232, Apple's Lightning® connector, as well as one or more ports for a conducted RF link.

As further illustrated, the electronic device 10 may include a power source 24. The power source 24 may include any suitable source of power, such as a rechargeable lithium polymer (e.g., Li-poly) battery and/or an alternating current (e.g., AC) power converter. The power source 24 may be removable, such as a replaceable battery cell.

The interface(s) 26 enable the electronic device 10 to connect to one or more network types. The interface(s) 26 may also include, for example, interfaces for a personal area network (e.g., PAN), such as a Bluetooth network, for a local area network (e.g., LAN) or wireless local area network (e.g., WLAN), such as an 802.11x Wi-Fi network or an 802.15.4 network, and/or for a wide area network (e.g., WAN), such as a 3rd generation (e.g., 3G) cellular network, 4th generation (e.g., 4G) cellular network, or long term evolution (e.g., LTE) cellular network. The interface(s) 26 may also include interfaces for, for example, broadband fixed wireless access networks (e.g., WiMAX), mobile broadband Wireless networks (e.g., mobile WiMAX), and so forth.

Figure 2:
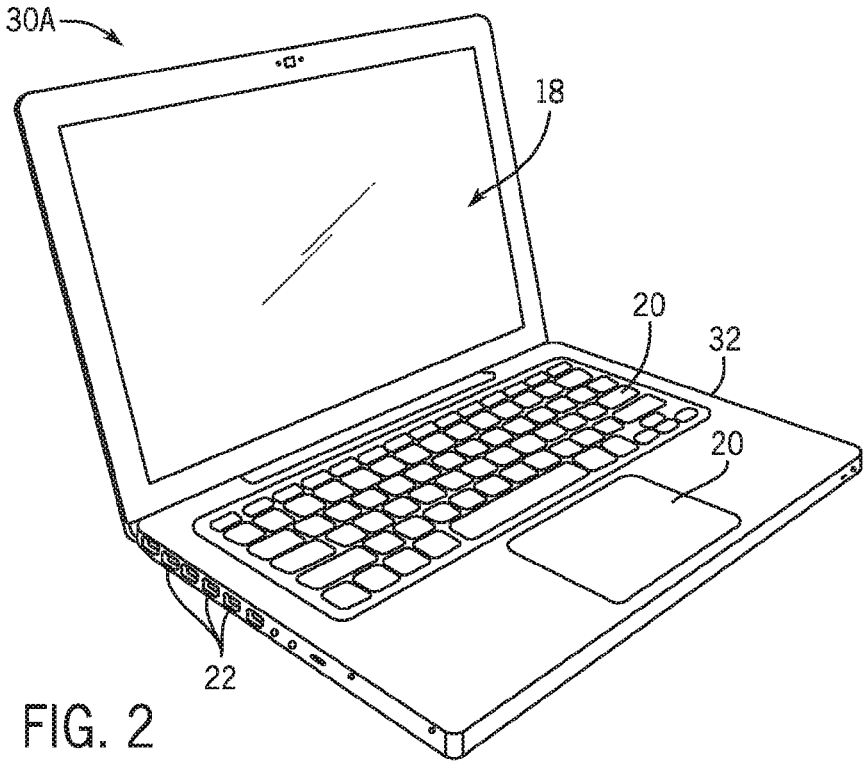
FIG. 2 is a perspective view of a notebook computer representing an embodiment of the electronic device of FIG. 1, in accordance with an embodiment.
Figure 4:
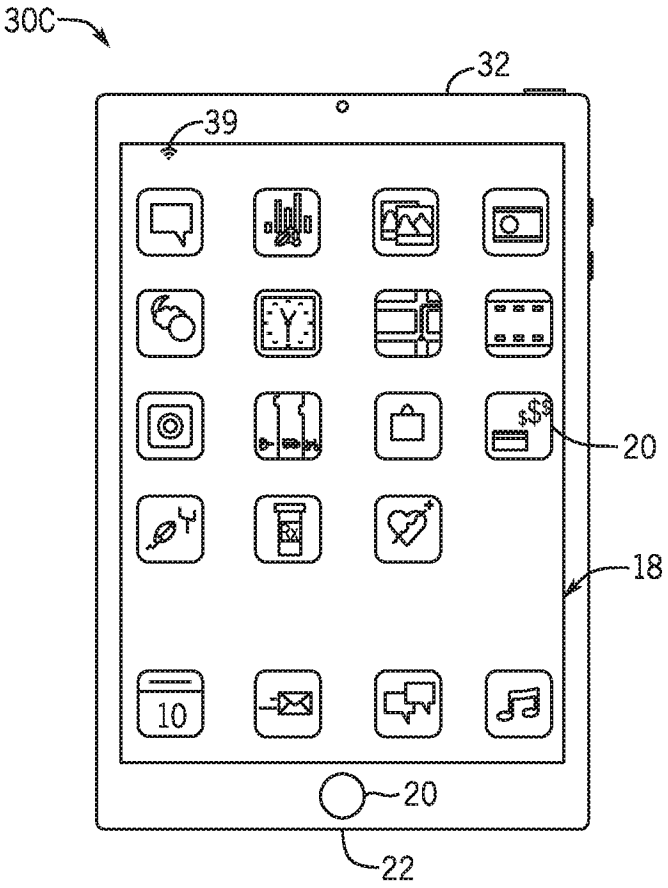
FIG. 4 is a front view of another hand-held device representing another embodiment of the electronic device of FIG. 1, in accordance with an embodiment.
Figure 3:
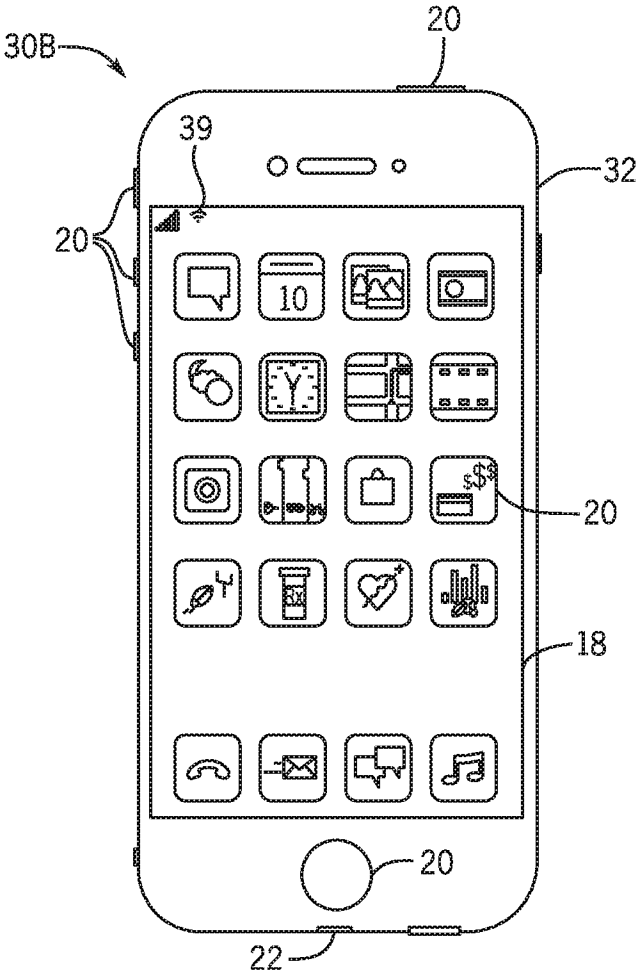
FIG. 3 is a front view of a hand-held device representing another embodiment of the electronic device of FIG. 1, in accordance with an embodiment.
Figure 5:
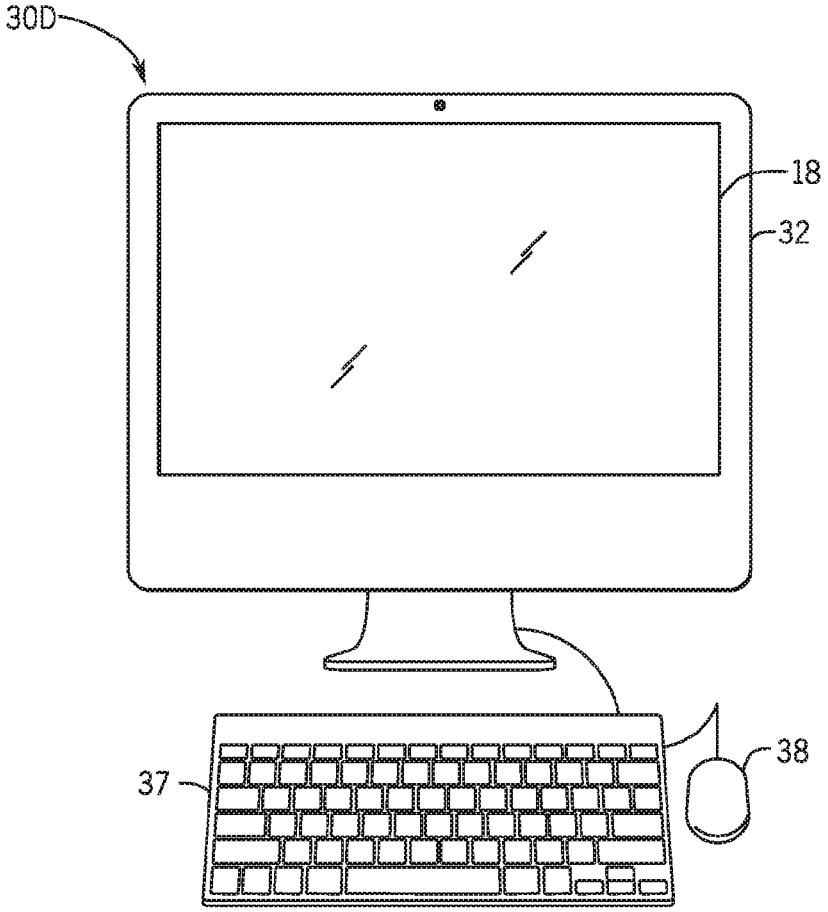
FIG. 5 is a front view of a desktop computer representing another embodiment of the electronic device of FIG. 1, in accordance with an embodiment.
Figure 6:
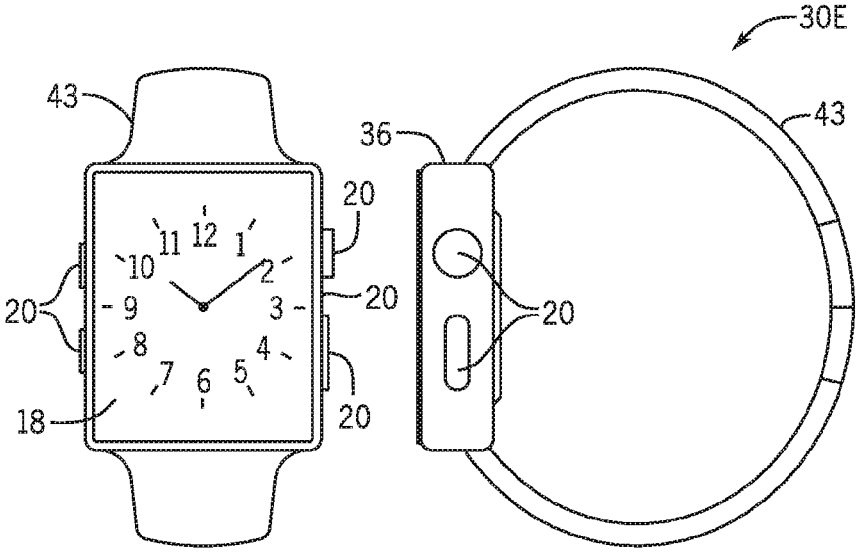
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 20, and ports of the I/O interface 22. In one embodiment, the input structures 20 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a model of an iPod® or iPhone® available from Apple Inc. of Cupertino, Calif.

The handheld device 30B may include an enclosure 32 to protect interior components from physical damage and to shield them from electromagnetic interference. The enclosure 32 may surround the display 18, which may display indicator icons 39. The indicator icons 39 may indicate, among other things, a cellular signal strength, Bluetooth connection, and/or battery life. The I/O interfaces 22 may open through the enclosure 32 and may include, for example, an I/O port for a hard wired connection for charging and/or content manipulation using a connector and protocol, such as the Lightning connector provided by Apple Inc., a universal serial bus (e.g., USB), one or more conducted RF connectors, or other connectors and protocols.

The illustrated embodiments of the input structures 20, in combination with the display 18, may allow a user to control the handheld device 30B. For example, a first input structure 20 may activate or deactivate the handheld device 30B, one of the input structures 20 may navigate user interface to a home screen, a user-configurable application screen, and/or activate a voice-recognition feature of the handheld device 30B, while other of the input structures 20 may provide volume control, or may toggle between vibrate and ring modes. Additional input structures 20 may also include a microphone that may obtain a user's voice for various voice-related features, and a speaker to allow for audio playback and/or certain phone capabilities. The input structures 20 may also include a headphone input (not illustrated) to provide a connection to external speakers and/or headphones and/or other output structures.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (e.g., PC) by another manufacturer. A similar enclosure 32 may be provided to protect and enclose internal components of the computer 30D such as the display 18. In certain embodiments, a user of the computer 30D may interact with the computer 30D using various peripheral input devices, such as a keyboard 37 or mouse 38, which may connect to the computer 30D via an I/O interface 22.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., e.g., pedometer, accelerometer, heart rate monitor), or other device by another manufacturer. The display 18 of the wearable electronic device 30E may include a touch screen (e.g., e.g., LCD, an organic light emitting diode display, an active-matrix organic light emitting diode (e.g., AMOLED) display, and so forth), which may allow users to interact with a user interface of the wearable electronic device 30E.

Figure 7:
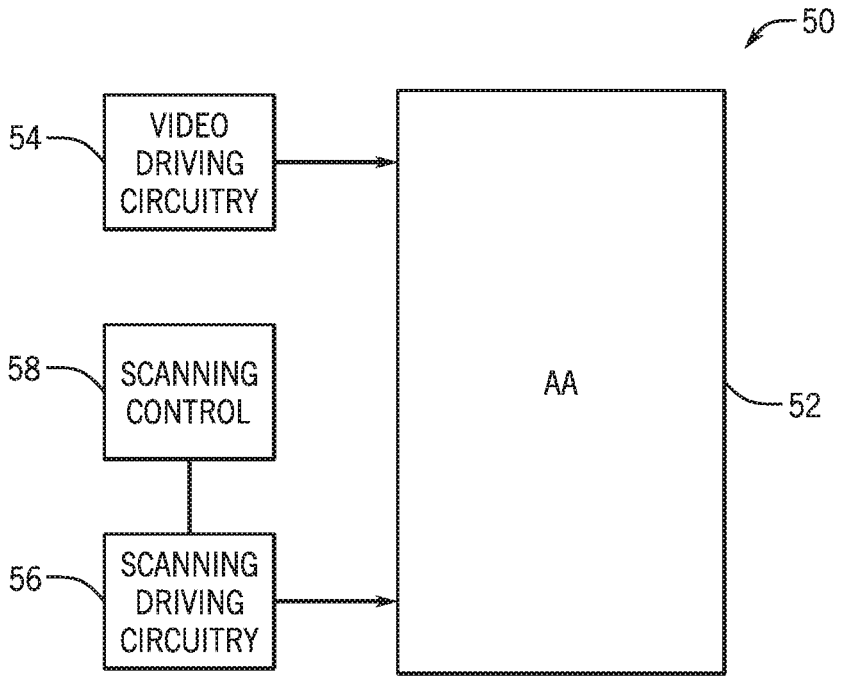
FIG. 7 is a schematic view of a display system that includes an active area and driving circuitry for display and sensing modes, in accordance with an embodiment.
Figure 8:
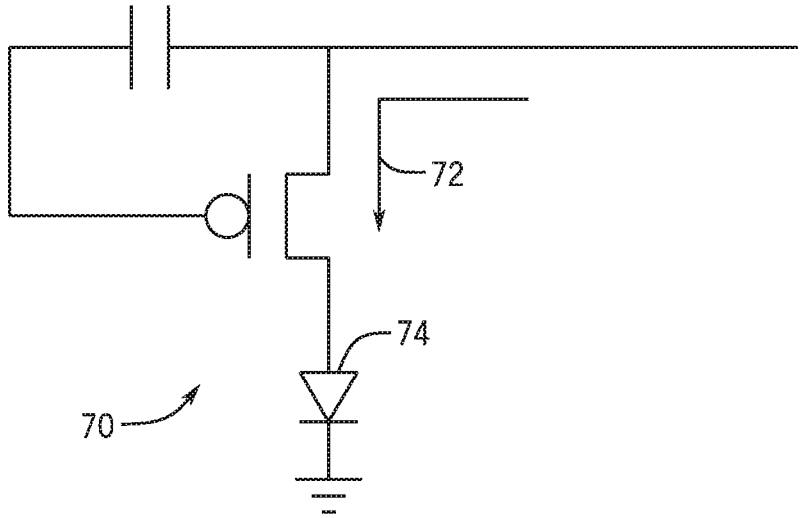
FIG. 8 is a schematic view of pixel circuitry of the active area of FIG. 7, in accordance with an embodiment.

FIG. 7 illustrates a display system 50 that may be included in the display 18 be used to display and scan an active area 52 of the display 18. The display system 50 includes video driving circuitry 54 that drives circuitry in the active area 52 to display images. The display system 50 also includes scanning (or sensing) driving circuitry 56 that drives circuitry in the active area 52. In some embodiments, at least some of the components of the video driving circuitry 54 may be common to the scanning driving circuitry 56. Furthermore, some circuitry of the active area may be used both for displaying images and scanning. For example, pixel circuitry 70 of FIG. 8 may be driven, alternatingly, by the video driving circuitry 54 and the scanning driving circuitry 56. When a pixel current 72 is submitted to an organic light emitting diode (OLED) 74 from the video driving circuitry 54 and the scanning driving circuitry 56, the OLED 74 turns on. However, emission of the OLED 74 during a scanning phase may be relatively low, such that the scan is not visible while the OLED 74 is being sensed. In some embodiments, the display 18 may include LEDs or other emissive elements rather than the OLED 74. To control of scans during the scanning mode, a scanning controller 58 of FIG. 7 may control scanning mode parameters used to drive the scanning mode via the scanning driving circuitry 56. The scanning controller 58 may be embodied using software, hardware, or a combination thereof. For example, the scanning controller 58 may at least be partially embodied as the processors 12 using instructions stored in memory 14 or in communication with the processors 12.

External or internal heat sources may heat at least a portion of the active area 52. Operation of the electronic device 10 with the active area heated unevenly may result in display artifacts if these heat variations are not compensated for. For example, heat may change a threshold voltage of the an access transistor of a respective pixel, causing power applied to the pixel to appear differently than an appearance the same power would cause in adjacent pixels undergoing a different amount of heat. During operation of the electronic device 10, compensation using the processors 12 may account for such artifacts due to ongoing sensing. However, during startup of the device 10, this external compensation may generally begin after communication is established between the display 18 (e.g., scanning driving circuitry 56 and/or scanning controller 58. During this startup time, if a preexisting thermal profile preexists the power cycle, the correction speed (e.g., $\tau$=0.3 s) may be too slow to prevent a waving artifact issue.

Figure 9:
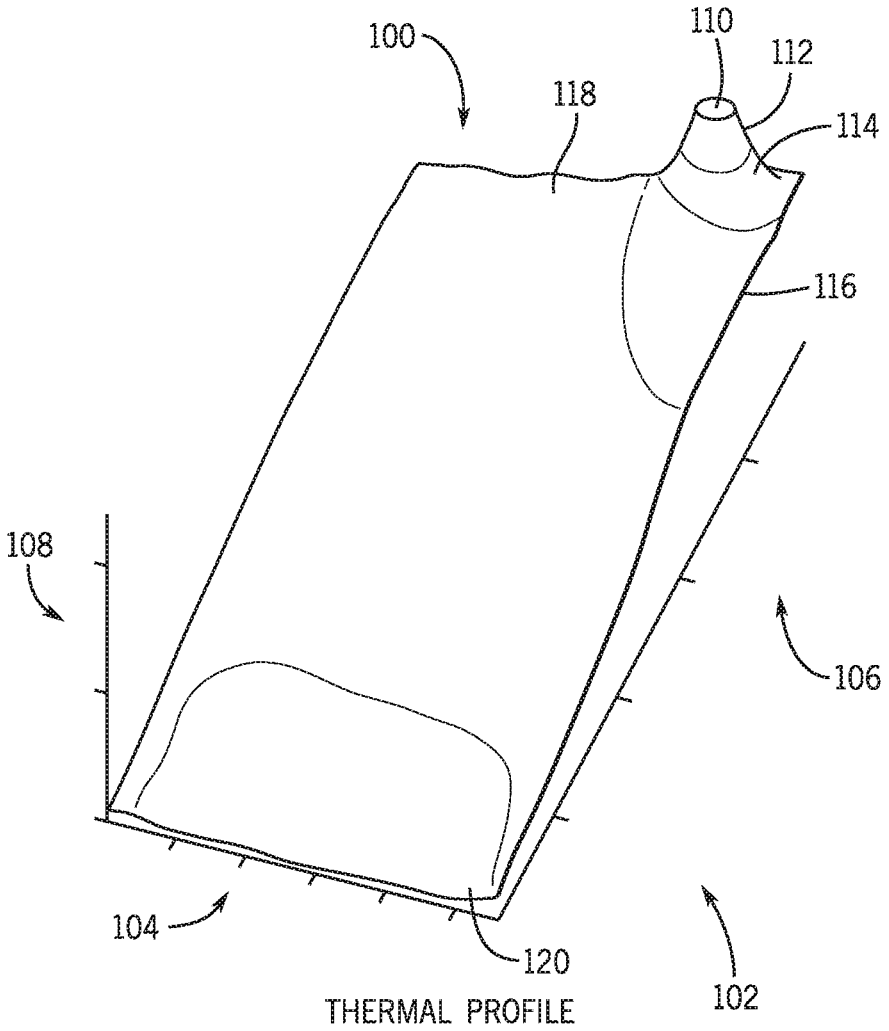
FIG. 9 is a graph of a thermal profile by location of the active area of FIG. 7 at boot up that may cause a display image artifact, in accordance with an embodiment.

FIG. 9 illustrates an embodiment of a possible thermal profile 100 illustrated on a graph 102 showing where actual heat exists in the electronic device 10. As illustrated, the graph 102 includes an x-axis 104 that corresponds to an x-axis of the active area 52. The graph 102 also includes a y-axis 106 that corresponds to a y-axis of the active area 52. Furthermore, the graph 102 includes a z-axis 108 that corresponds to temperature at a corresponding location on the x-y plane formed by the x-axis 104 and the y-axis 106. The thermal profile 100 includes multiple regions 110, 112, 114, 116, 118, and 120 (collectively referred to as "regions 110-120"). The temperature level of each of the regions 110-120 may be at least partially due to heat sources internal to the electronic device 10, such as wireless (e.g., LTE or WiFi) chips, processing circuitry, camera circuitry, batteries, and/or other heat sources within the electronic device 10. The temperature level of each of the regions may also be at least partially due to heat sources external to the electronic device 10.

Figure 10:
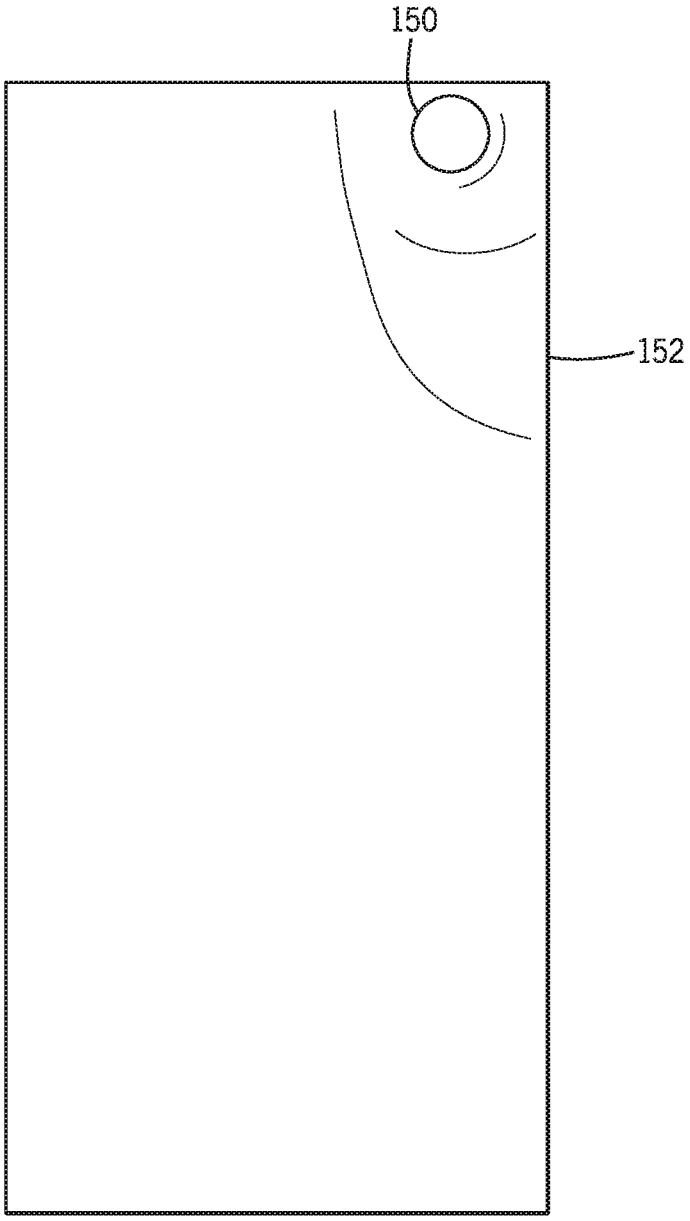
FIG. 10 is a diagram of a screen that may be displayed when the thermal profile of FIG. 9 exists at start up of a portion of the electronic device, in accordance with an embodiment.

Due to internal or external heat sources, heat in the regions 110-120 may vary throughout the active area 52 due to light (e.g., sunlight), ambient air temperatures, and/or other outside heat sources. As illustrated, the region 110 corresponds to a relatively high temperature. This temperature may correspond to a processing chip (e.g., camera chip, video processing chip) or other circuitry located underneath the active area 52. When the electronic device 10 boots up while having the thermal profile 100, the relatively high temperature of the region 110 may result in an artifact, such as the artifact 130 illustrated in FIG. 10. Specifically, the artifact 130 may be a brighter area of a screen 152 displayed by the display 18. The screen 152 is intended to display a consistent grayscale level throughout the screen 152. However, due to the temperature fluctuation throughout the screen 152 during boot up of the device, the screen 152 contains image artifacts due to temperature dependence of the active area 52. Specifically, the elevated temperature may result in an area corresponding to the region 110 that is brighter than remaining portions of the screen 152.

Furthermore, the thermal profile 100 may be built prior to or during the power cycle. For example, heat may remain through the power cycle due to operation of the electronic device 10 during a previous ON state for the electronic device 10. Additionally or alternatively, the power cycle may correspond to only some portions of the electronic device 10 (e.g., the display 18) while other portions (e.g., interfaces 26 and/or power source 24) remain active and possibly generating heat. The thermal profile 100 may be stored in memory 14 upon shutdown of the previous ON state. However, this thermal profile 100 is likely to change over time, and external compensation using the processors 12 is unlikely to be correct since the processors 12 may correct video data using a thermal profile 100 that is no longer current. Thus, such embodiments may result in artifacts corresponding to an incorrect thermal profile. Instead, the thermal profile 100 may be reset and to be correctly mapped during a sense phase of the display 18. However, since the sensing phase is generally sent to the processors 12 after communication is established with the processors 12 by the display 18. In other words, the processors 12 traditionally send image data to the display 18 at substantially the same time that the first image data is sent to the display 18 after start up or image data is sent after the first image data is sent to the display 18.

Figure 11:
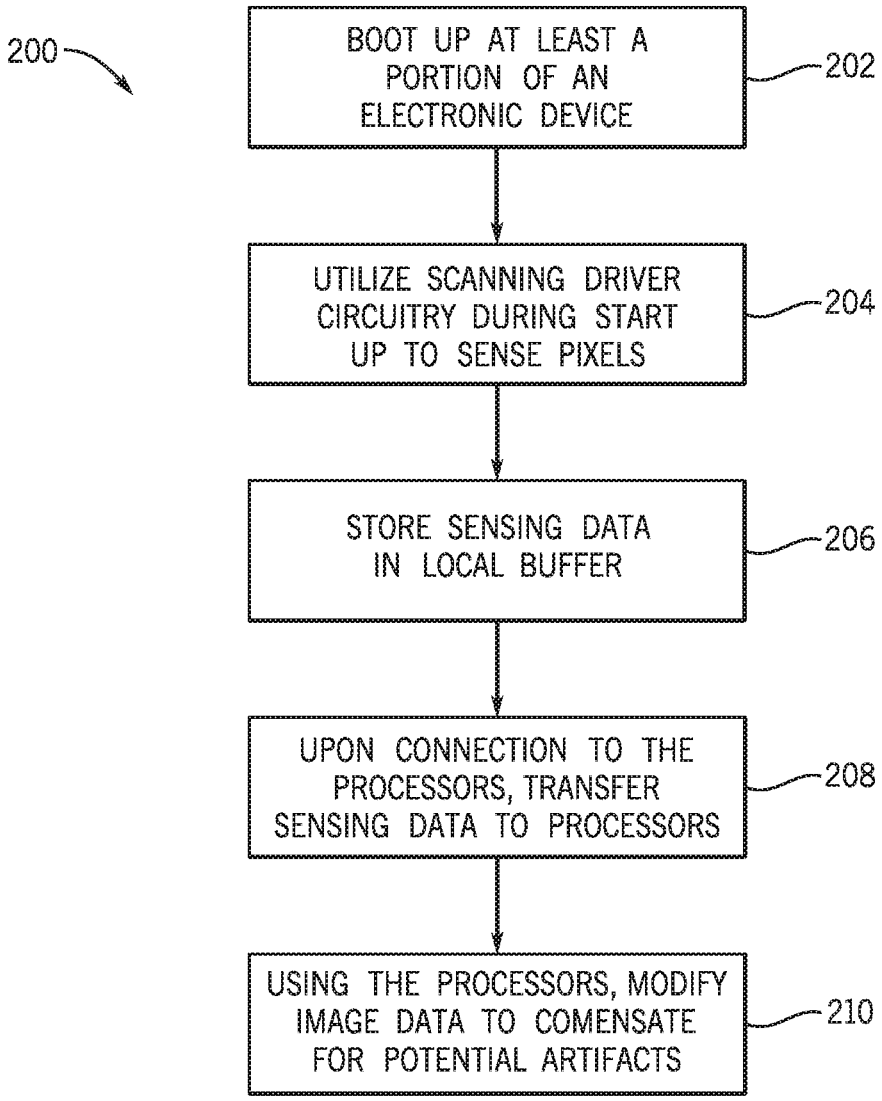
FIG. 11 is a flow diagram of a process for sensing during boot up, in accordance with an embodiment.

As illustrated in FIG. 11, the electronic device 10 may utilize a process 200 for accounting for potential artifacts due to boot up thermal profiles. The process 200 includes booting up at least a portion of the electronic device 10 (block 202). Booting up may include booting up the whole electronic device 10 or may include booting up only a portion (e.g., the display 18). During boot up, the scanning driving circuitry 56 may start sensing pixels of the active area 52 (block 204). The scanning driving circuitry 56 and/or the scanning controller 58 may be programmed to cause sensing of at least some of the pixels of the active area 52 before initiating communication with the processors 12 and/or prior to receiving any image data from the processors 12.

Furthermore, sensing of the pixels of the active area 52 may include sensing only a portion of the pixels. For example, pixels in key locations, such as those near known heat sources, may be scanned. Additionally or alternatively, a sampling representative of the active area 52 may be made. It is noted that an amount of pixels scanned may be a function of available buffer space since the sensing data is stored in a local buffer (block 206). The local buffer may be located in or near the scanning driving circuitry 56 and/or the scanning controller 58. The local buffer is used for boot up scanning since communication with the processors 12 has not been established in the boot up process before the sensing of pixels begin. As previously noted, the buffer size may be related to how many pixels are sensed during the sensing scan. For example, if only strategic locations are stored, the local buffer may include twenty line buffers, over a thousand line buffers may be used if all pixels are sensed during the boot up scan.

Once communication is established between the display 18 and the processors 12, the sensing data is transferred to the processors 12 (block 208). The processors 12 then modify image data to compensate for the potential artifacts (block 210). For example, the image data may be modified to reduce luminance levels of pixels corresponding to locations indicating a relatively high temperature.

Figure 12:
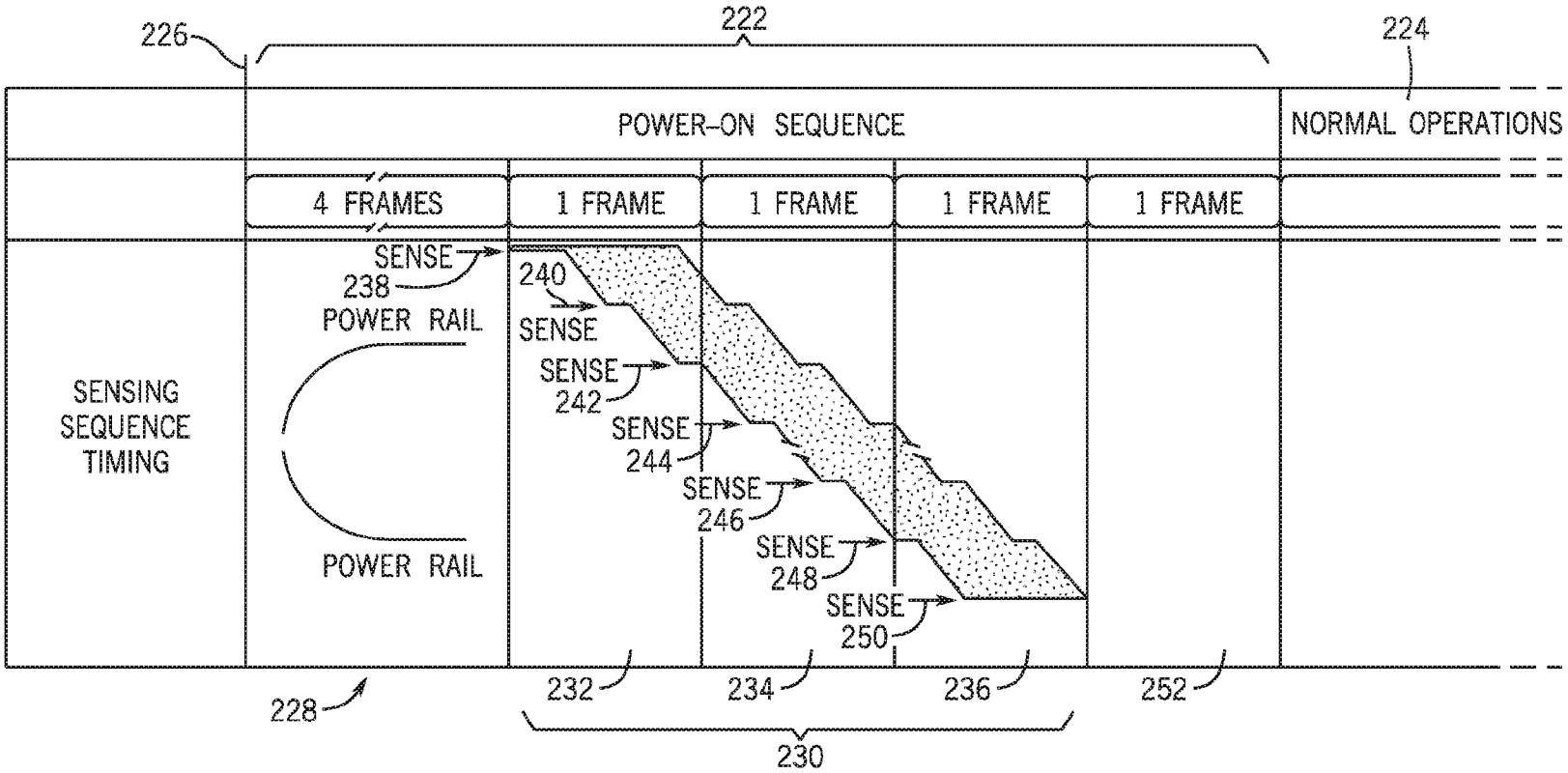
FIG. 12 is a timing diagram of the boot-up sensing of FIG. 11, in accordance with an embodiment.

FIG. 12 illustrates a timing diagram 220 that may be used to sense pixels during a power-on sequence. As illustrated, the timing diagram 220 includes a power on sequence 222 that occurs before a normal operation mode 224 after a boot up event 226. As previously discussed, the boot up event may be a boot up of the entire electronic device 10 or may only be a portion of the electronic device 10 (e.g., display 18). The power on sequence 222 includes a power rail settling period 228 that includes a period of time adequate to allow power rails of the display 18 to sufficiently settle. In the illustrated embodiment, the power rail settling period 228 includes a duration equivalent to four frames (e.g., 33.2 ms). However, the power rail settling period 228 may be set to any duration sufficient to adequately settle the power rails. After the power rails have settled, the scanning driving circuitry 56 and/or the scanning controller 58 begin boot-up sensing 230. In the illustrated embodiment, the boot-up sensing 230 lasts through frames 232, 234, and 236. However, this duration may be programmable to any period and may at least partially depend on how many pixels are scanned during the boot-up sensing 230. For example, the illustrated embodiment includes sensing lines 238, 240, 242, 244, 246, 248, and 250. If additional lines/pixels are to be scanned, additional frames may be programmed into the boot-up sensing 230. During a clock transition period 252 after the boot-up sensing 230, communication between the display 18 (e.g., the sensing driving circuitry 56 and/or the sensing controller 58) may be established and normal operation 224 uses a clock signal that is also used by the processors 12.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

a display comprising:

one or more pixels, wherein the one or more pixels of the display are configured to:

in a display mode, display images based on image data; and in a pixel sense mode, provide operational information about operation of the one or more pixels; and sensing driving circuitry that drives sensing of the one or more pixels of the display during the pixel sense mode; and at least one processor configured to modify image data before displaying on the display based at least in part on results of a boot up scan by the sensing driving circuitry that drives sensing of the operational information about the operation of the one or more pixels;

wherein the sensing driving circuitry is configured to:

during a period before a boot up sequence of at least a portion of the electronic device completes, scan at least a portion of the one or more pixels using the boot up scan;

store the results of the boot up scan as a thermal profile used to modify image data based on the boot up scan to reduce likelihood of image artifacts after boot up; and send the results of the boot up scan to the at least one processor upon connection to the at least one processor to cause the processor to modify initial image data after the boot up using the thermal profile.

2. The electronic device of claim 1, wherein the portion comprises only a portion of the electronic device comprising the display.

3. The electronic device of claim 1, wherein the period before the boot up sequence completes comprises a period before the boot up sequence has initiated.

4. The electronic device of claim 3, wherein the display is off during the period before the boot up sequence has initiated while one or more other parts of the electronic device are on.

5. The electronic device of claim 1, wherein the electronic device is in an off state prior to the boot up sequence and is configured to be booted up by the boot up sequence.

6. The electronic device of claim 1, wherein the period before the boot up sequence completes prior to established connection between the sensing driving circuitry and the at least one processor.

7. The electronic device of claim 1, wherein the period before the boot up sequence completes prior to the display receiving image data from the at least one processor.

8. The electronic device of claim 1, wherein the boot up sequence comprises:

a power rail settling period in which power rails settle; and a boot-up sensing period during which the scan is completed, wherein the boot-up sensing period follows the power rail settling period and occurs before normal operation of the display begins.

9. The electronic device of claim 8, wherein the power rail settling period comprises a period of four frames or fewer.

10. The electronic device of claim 8, wherein the boot-up sensing period spans a number of frames corresponding to a period of time used to scan the at least a portion of the one or more pixels.

11. The electronic device of claim 10, wherein a number of the at least a portion of the one or more pixels is based at least in part on a size of storage space for storing the results of the boot up scan.

12. The electronic device of claim 10, wherein the at least a portion of the one or more pixels comprises all of the pixels.

13. The electronic device of claim 10, wherein the at least a portion of the one or more pixels comprises pixels in certain distinct locations around the display.

14. The electronic device of claim 13, wherein the certain distinct locations comprise:

locations configured to undergo more heating than other locations;

locations configured to be representative of the entire display; or a combination thereof.

15. The electronic device of claim 8, wherein the boot up sequence comprises a clock transition phase wherein the display first establishes connection with the at least one processor during the boot up sequence after the power rail settling period and a boot-up sensing period.

16. A method for reducing artifacts during a boot up of at least a portion of an electronic device comprising:

booting up the at least a portion of an electronic device;

before or during the boot up, scanning at least a portion of one or more pixels using a boot up scan using scanning driving circuitry;

storing results of the boot up scan as a thermal profile used to modify image data based on the boot up scan to reduce likelihood of image artifacts after boot up;

sending the results of the boot up scan to at least one processor upon first connection to the processor; and compensating for potential artifacts using the at least one processor by modifying initial image data after the boot up based on the results of the boot up scan.

17. The method of claim 16, wherein the results of the boot up scan establish sensed values of the thermal profile that is present at boot up, wherein the thermal profile causes the potential artifacts if not compensated for while displaying images using the display.

18. The method of claim 17, wherein the thermal profile comprises:

the thermal profile established while display or electronic device is off;

the thermal profile established during a previous ON mode that persists through a power cycle; or a combination thereof.

19. Scanning driving circuitry comprising:

control circuitry configured to scan at least a portion of one or more pixels of an active area of a display using a boot up scan before a boot up sequence of at least a portion of an electronic device completes, wherein the control circuitry is configured to scan the at least a portion using the boot up scan without interaction with any of one or more processors of the electronic device;

local buffers configured to store results of the boot up scan as a thermal profile used to modify image data based on the boot up scan to reduce likelihood of image artifacts after boot up; and a transmitter configured to send the results of the boot up scan to the one or more processors after connection to the one or more processors to cause the processor to modify initial image data after the boot up using the thermal profile.

20. The scanning driving circuitry of claim 19, wherein the transmitter is configured transfer the results of the boot up scan to the one or more processors during a boot up sequence as soon as communication between the one or more processors and the scanning driving circuitry are established.

* * * * *